United States Patent [19]

Haddock et al.

[11] Patent Number: 5,048,452

[45] Date of Patent: Sep. 17, 1991

[54] RACQUET-MOUNTED SCORING DEVICE

[76] Inventors: Perry S. Haddock, 2618-206th Street, Langley, British Columbia, Canada, V3A 4P5; Wayne M. Fraser, 15388 Columbia Avenue, White Rock, British Columbia, Canada, V4B 1J9

[21] Appl. No.: 468,874

[22] Filed: Jan. 23, 1990

[51] Int. Cl.[5] ..... A63B 71/06; G09F 9/40

[52] U.S. Cl. ..... 116/225; 116/324

[58] Field of Search ..... 116/222, 225, 306, 307, 116/321-324; 40/491, 630; 235/1 B; 273/73 R, DIG. 26

[56] References Cited

U.S. PATENT DOCUMENTS

| | | | |
|---|---|---|---|
| 4,165,710 | 8/1979 | Gaetano | 116/223 |
| 4,189,143 | 2/1980 | Van Auken et al. | 273/73 R |
| 4,202,544 | 5/1980 | Popma | 273/73 R |
| 4,331,098 | 5/1982 | Rubano | 116/225 |
| 4,498,668 | 2/1985 | Bowen | 273/73 R |
| 4,712,504 | 12/1987 | Zarley et al. | 116/222 |
| 4,738,449 | 4/1988 | Droz | 273/29 R |
| 4,825,803 | 5/1989 | Ammann et al. | 116/324 |
| 4,951,596 | 8/1990 | Wallace, Jr. | 116/321 |

FOREIGN PATENT DOCUMENTS

| | | | |
|---|---|---|---|
| 331 | 1/1932 | Australia | 116/225 |
| 24552 | 3/1981 | European Pat. Off. | 273/73 R |
| 2445727 | 9/1980 | France | 273/DIG. 26 |
| 2460689 | 3/1981 | France | 273/DIG. 26 |
| 8400938 | 10/1985 | Netherlands | 273/DIG. 26 |

*Primary Examiner*—William A. Cuchlinski, Jr.
*Assistant Examiner*—W. Morris Worth
*Attorney, Agent, or Firm*—John R. Uren

[57] ABSTRACT

A scoring device for use in racquet games. A track member is mounted to a base member by an attachment means which allows relative movement between the base and track members. Scoring indicators move along the track member. An adhesive label is attached to the base member to allow its attachment to a curved surface and, more particularly, to the curved surface such as that of a throat of a racquet.

15 Claims, 2 Drawing Sheets

RACQUET-MOUNTED SCORING DEVICE

INTRODUCTION

This invention relates to a scoring device and, more particularly, to a scoring device which is mounted to a racquet and which may be used for a plurality of racquet games.

BACKGROUND OF THE INVENTION

Scorekeeping devices, particularly in highly competitive games, are often used during racquet games to enable the players to keep an accurate record of the score throughout the match without shifting concentration from the performance of the game itself. Such devices are typically mounted in a position removed from the players and playing court which, of course, is disadvantageous because of the need for an operator. Without such scorekeeping devices, extended rallies and interruptions to the game can cause a break in concentration on the scoring of the game which may result in disagreements or inaccuracy of the score at any given time.

Racquet game scoring devices of various types which are connected to a racquet are known. These score keeping devices, however, have various disadvantages which limit their utility.

Scorekeeping devices with linear channels along which one or more indicator markers can be moved to register a score have been described in the prior art as shown in U.S. Pat. No. 4,498,668 to Bowen. The Bowen device is not designed for racquetball and squash, nor is it designed to be mounted on a curved surface. The Bowen markers are also subject to loosening and movement during the course of a game, since the markers are not locked into their score indicating positions.

U.S. Pat. No. 4,189,143 to Van Auken et al teaches a device intended to be mounted on the front face of a tennis racquet handle and not on a curved surface. This Van Arken et al device, however, suffers from the further disadvantage that some racquets are designed to be open below the racquet head, which would make it difficult or impracticable to mount the Van Auken et al device. The Van Auken et al device is not easily capable of keeping score in racquetball and squash.

U.S. Pat. No. 4,712,504 to Zarley et al teaches a device intended to be mounted on the outer edge of a racquet frame which may be a curved surface. The Zarley et al device, however, suffers from the disadvantage that the markers are not locked into their positions and are subject to loosening and movement. The Zarley et al device is not intended to record the games won and lost by either player. It scores only the points in the game under play. The Zarley et al device is not designed to keep score of games other than tennis.

SUMMARY OF THE INVENTION

According to the invention, there is provided a scoring device comprising a base member, a track member, means for removably mounting said track member to said base member to allow relative movement between said base member and said track member and at least one score indicator movable relative to said track member.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
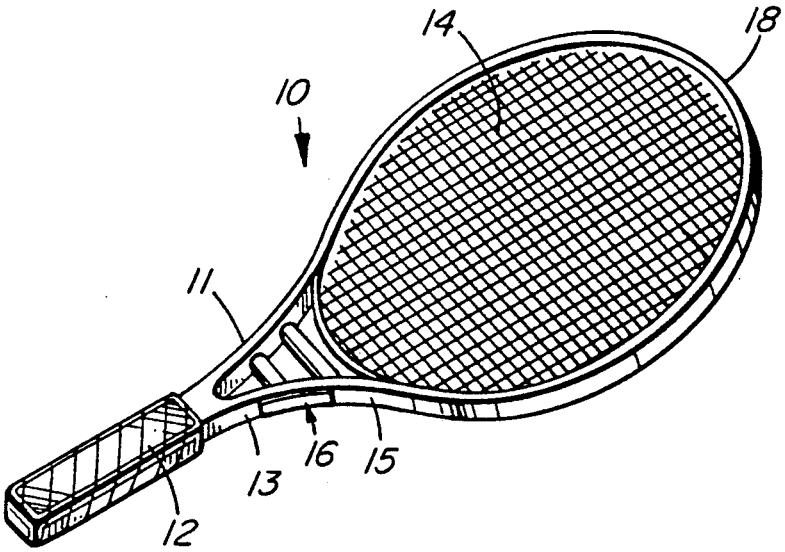
FIG. 1 is an isometric view of a racquet with the attached scoring device according to the invention.

Referring now to the drawings, a tennis racquet is illustrated generally at 10 in FIG. 1. The racquet 10 includes a frame 11, a handle 12, a yoke section 13, and an open frame segment or head 18 carrying strings 14. The racquet 10 has an outer edge 15 running generally from one side of the handle 12, around the head 18 and back to the opposite side of the handle 12.

A scoring device according to the invention is illustrated generally at 16. The scorekeeping device 16 comprises an elongate body member generally illustrated at 17 (FIG. 2) and made from acetal material. The scoring device 16 is secured to the outer edge 15 of racquet 10 by double-sided adhesive tape 20 (FIG. 8) which is first attached to the body member 17. The scoring device 16 is flexible so that it may be curved to conform to the curved configuration of the outer edge 15 of frame 11, as will be described in greater detail hereafter.

The scoring device 16 includes a base member 30, a track member 31 movably mounted to the base member 30 by the use of snap fasteners 40, 41 and an indicia representing label 32 removably mounted to the track member 31. The edges 50 of the track member 31 are of "sawtooth" configuration for the purpose described hereafter.

The snap fasteners 40, 41 are integral with the base member 30 and are oval shaped in plan view. Each snap fastener 40, 41 contains a groove 42 (FIG. 8) which allows the upper and outwardly extending arms 43, 44 of each snap fastener 40, 41 to be displaced inwardly toward the centerline 47 of the snap fasteners 40, 41 thereby to allow the track member 31 to be attached by the snap fasteners 40, 41 to the base member 30.

Track member 31 includes two elongate slots 45, 46, each approximately 0.375 inches in length with circular end walls. Snap fasteners 40, 41 are approximately 0.24 inches in length thereby allowing track member 31 to be displaced along its longitudinal axis relative to base member 30. When the base member 30, which is relatively thin, is bent or curved to conform to a curved outer edge 15 of the racquet 10, the track member 31 will move relative to the base member 30 as the snap fasteners 40, 41 slide within the slots 45, 46 of the track member 31.

Figure 8:
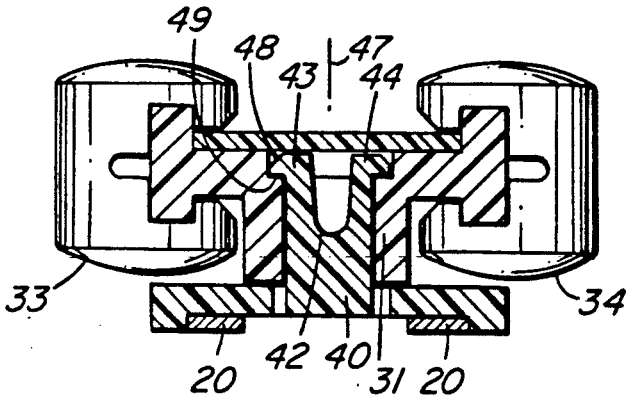
FIG. 8 is a cross-section taken along VIII—VIII of FIG. 6.
Figure 5:
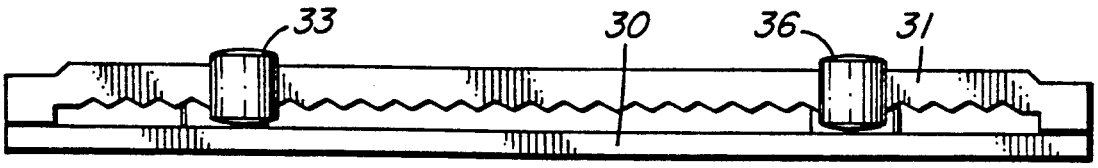
FIG. 5 is a side view of the scoring device of FIG. 2.

Base member 30 is affixed to track member 31 by placing the track member 31 on top of base member 30 and pressing down evenly so as to allow snap fasteners 40, 41 to protrude through elongate slots 45, 46, respectively, after they snap into position as best illustrated in FIG. 8. During the assembly, track member 31 and base member 30 are forced together so as to cause the upper arms 43, 44 of snap fasteners 40, 41 to be displaced inwardly until the shoulders 48 of snap fasteners 40, 41 snap into the complementary recess 49 of slots 45, 46, thus allowing the arms 43, 44 of snap fasteners 40, 41 to return to their original positions.

Figure 6:
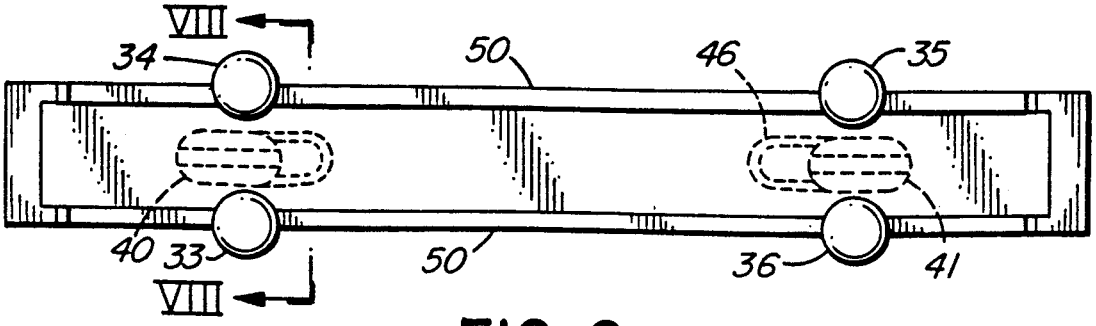
FIG. 6 is a plan view of the scoring device of FIG. 5.

Score indicators in the form of markers 33, 34, 35, 36 (FIG. 2 and FIG. 6) slide on the sawtooth edges 50 of the track member 31, two markers being used for each player. The markers are approximately 0.24 inches in thickness and approximately 0.25 inches in diameter when viewed in plan. Sawtooth edge 50 of track member 31 prevents the markers 33, 34, 35, 36 from accidentally or inadvertently moving during play.

OPERATION

Figure 2:
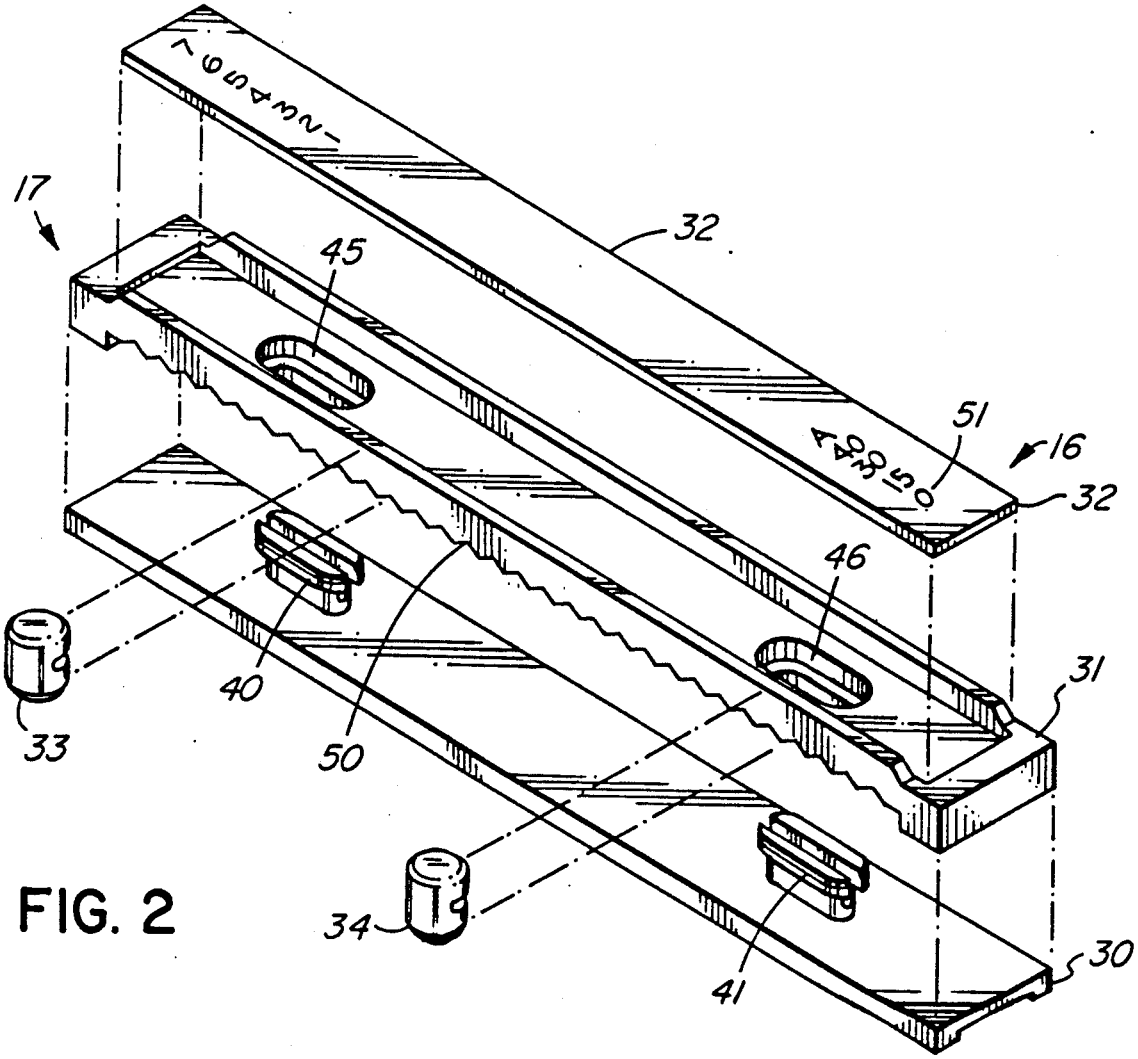
FIG. 2 is a diagrammatic isometric exploded view of the scoring device in an unmounted condition.

In operation, it will be assumed that the game being played is tennis and, accordingly, the label 32 removable affixed to the track member 31 will be that label 32 illustrated in FIG. 2 with the points illustrated in the lower area of the label 32 and the games being illustrated in the upper area of the label 32.

An adhesive tape 20 will be affixed to the bottom of base member 30 in the recess provided as best shown in FIG. 8. The adhesive tape 20, of course, is double sided and, following installation in the base member 30, the scoring device 16 will be affixed to the desired surface of the racquet 10.

It will be noted that the base member 30 is relatively thin and, therefore, it may be readily curved in order to conform to a curved surface such as that surface illustrated in FIG. 1. As the base member 30 is curved and pressed onto the curved surface, the track member 31 can move relative to the base member 30 since it is not integral with the base member 30. Thus, the track member 31 will conform to the shape of the base member 30 and the distance between the base member 30 and the track member 31 where the markers 33, 34, 35, 36 move will remain relatively a constant distance apart because of the use of the snap fasteners 40, 41. The markers 33, 34, 35, 36, therefore, will move in a relatively uniform manner regardless of the shape of the surface on which the scoring device 16 is mounted.

As the game proceeds and after each point is made, each player will move the proper marker 35, 36 to the correct indicia showing the score in the area 51 of the label 32. Marker 36, for example, could be used to reflect the score of one player and marker 35 would reflect the score of his opponent. Following each game, markers 33, 34 would be moved appropriately to reflect the game count of each player.

Figures 3, 4:
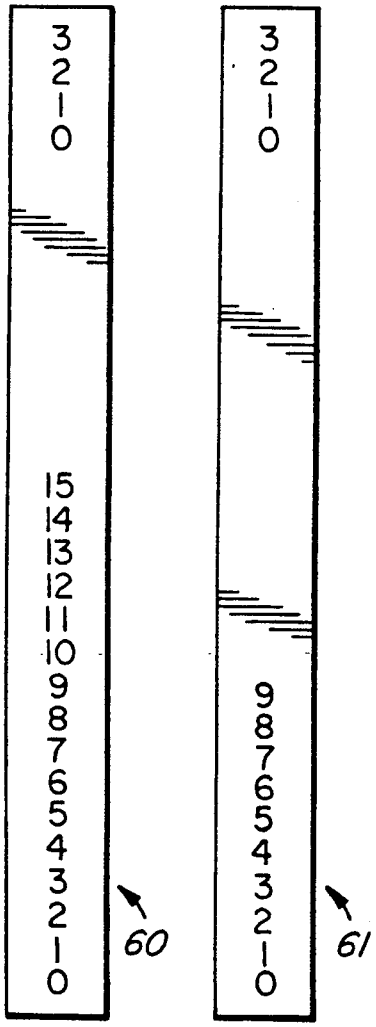
FIG. 3 is a plan view of a label which may be used for racquetball.
FIG. 4 is a plan view of a label which may be used for squash.
Figure 7:
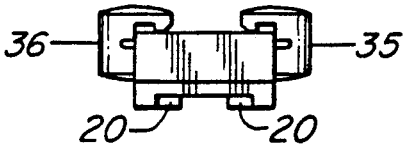
FIG. 7 is an end view of the scoring device of FIG. 5.

If the game being played is not tennis but, rather, is racquetball or squash, the label 32 is simply replaced or covered with the appropriate label for that game. A squash label 61, for example, is illustrated in FIG. 4 while a racquetball label 60 is illustrated in FIG. 3. Other racquet sports such as badminton could also benefit from the use of the scoring device according to the invention.

Many modifications or other uses will readily occur to those skilled in the art. For example, the device might be attached to hockey sticks in pickup games and the like. Indeed, the device might be used for scorekeeping and mounted to virtually any instrument in any game which remains in the players control throughout. However, the scoring device might well be used for scorekeeping in other games which do not necessarily use racquets but where the teachings of the invention would be advantageous.

Many further modifications will occur to those skilled in the art to which the invention relates and the specific embodiments herein described should be taken as illustrative of the invention only and not as limiting its scope as defined in accordance with the accompanying claims.

What is claimed is:

1. A scoring device comprising a flexible elongate base member, a flexible elongate track member having score indicating indicia thereon, means for mounting the track member on the base member so that the longitudinal axis of the members are in a alignment and the members being capable of relative movement with respect to each other when the members are flexed about a transverse axis, and at least one score indicator mounted to said track member so as to be selectively movable relative to said track member for indicating a score according to its position relative to the score indicating indicia on the track member.

2. A scoring device as in claim 1 wherein said score indicating indicia are located on a label which is removably mounted on said track member.

3. A scoring device as in claim 1 wherein said mounting means comprises a snap fastener and a cooperating elongate recess in which the snap fastener is capable of performing longitudinal movement relative to the recess.

4. A scoring device as in claim 3 wherein said mounting means includes a second snap fastener.

5. A scoring device as in claim 4 and further comprising means for connecting said base member to a racquet.

6. A scoring device as in claim 5, wherein said connecting means is double sided adhesive tape.

7. A scoring device as in claim 6 wherein said score indicator comprises first and second markers movably mounted on said track member for indicating a score according to their positions relative to the score indicating indicia on the track member and wherein said markers are located on opposite sides of the track member.

8. A scoring device as in claim 7 wherein said score indicating indicia represent a racquet game.

9. A scoring device as in claim 8, wherein said racquet game is tennis.

10. A scoring device as in claim 9, wherein said indicia represent points and games.

11. A scoring device as in claim 8, wherein said racquet game is racquetball.

12. A scoring device as in claim 11, wherein said indicia represent points and games.

13. A scoring device as in claim 8, wherein said racquet game is squash.

14. A scoring device as in claim 13, wherein said indicia represent points and games.

15. A scoring device as in claim 7 wherein a pair of said first markers are provided on the one side of the track member to indicate the score of one player and a pair of said second markers are provided on the opposite side of the track member to indicate the score of a second player.

* * * * *